US005651302A

United States Patent [19]

Mills

[11] Patent Number: 5,651,302

[45] Date of Patent: Jul. 29, 1997

[54] ACTUATOR PUMP

[75] Inventor: Douglas W. Mills, Freeport, Ill.

[73] Assignee: Fabco Air, Inc., Gainesville, Fla.

[21] Appl. No.: 678,693

[22] Filed: Jul. 11, 1996

[51] Int. Cl.[6] ..... F01B 15/02

[52] U.S. Cl. ..... 92/117 A; 92/111; 92/165 R; 417/469; 417/460; 417/523

[58] Field of Search ..... 92/111, 117 R, 92/117 A, 165, 165 PR; 417/460, 466, 469, 523

[56] References Cited

U.S. PATENT DOCUMENTS

| | | | |
|---|---|---|---|
| 2,255,395 | 9/1941 | Spink | 92/165 PR |
| 4,334,833 | 6/1982 | Gozzi | 417/469 |
| 4,755,113 | 7/1988 | Rasmussen | 417/469 |
| 4,829,880 | 5/1989 | Lieberman | 92/165 R |
| 5,118,265 | 6/1992 | Bearss | 417/534 |
| 5,529,463 | 6/1996 | Layer et al. | 417/460 |

*Primary Examiner*—Thomas E. Denion
*Attorney, Agent, or Firm*—Edward M. Livingston, Esq.

[57] ABSTRACT

An actuator pump has one or more colinear piston cylinders (2, 3, 25) in a cylinder housing (1) in which change of volume is provided by reciprocative relationship of colinear pistons (4, 5, 23, 24,) in the colinear piston cylinders. One or more travel guides (6, 8) in sliding contact with guide cylinders (7, 9) in the cylinder housing are parallel to the travel guides. The colinear pistons and travel guides are attached to pump bases (10, 11) at opposite ends of the travel guides. Inward-pressured rings (14, 26), outward-pressured rings (29), fluid conveyances (16, 19, 30, 31), valves (36) and attachment components (21) for reciprocative actuation are provided selectively for particular design requirements.

19 Claims, 3 Drawing Sheets

10
6
20
1
7
20
11
21
21
27
26
30
32
33
36
24
12
25
34
28
37
31
35
32
30
29
34
23
37
33
31
25
35
36
36
37
12
21
20
8
9
20
8
29
36
36
37
37
12
32
30
33
24
25
34
31
35
19
14
23
18
25
12
17
15
20
8
9
20
8

ACTUATOR PUMP

BACKGROUND OF THE INVENTION

This invention relates to pumps and compressors. More particularly, it relates to reciprocative pumps and compressor in which either a cylinder or a piston reciprocates to provide controlled change of volume for actuating mechanisms with liquid or gaseous fluid instead of solid actuational members.

Previous reciprocative pumps and compressors have employed reciprocation of pistons in cylinders to convey or to compress volumes of either liquid or gaseous fluid. None, however, provide the unique operation of special machinery such as robotics, manufacturing equipment, automation, mechanism control and various actuation devices in a manner taught by this invention. Due apparently to differences of needs for prior technology from requirements for special technological advancements, reciprocation of cylinders or pistons for fluid actuation in a manner taught by this invention is not known or believed to exist previously.

SUMMARY OF THE INVENTION

In light of need for improved actuation of precision mechanisms, objects of this invention are to provide an actuator pump which:

Allows precision machining and/or grinding of outside diameters, such as on pistons, instead of inside diameters, such as with cylinders, for sliding-seal surfaces of particularly hard, corrosion-resistant, heat-resistant and non-lubricated-solid materials to high levels of smoothness and accuracy of relatively long circumferential surfaces for a high range of precise actuation of machinery and devices with an actuator pump;

Facilitates use of inward-pressured rings in cylinders instead of outward-pressured rings in pistons for particular design requirements;

Has a cylinder-travel guide for assuring accurate linear travel of reciprocative components of a high-precision actuator pump; and Allows a plurality of select sizes, shapes and types of actuation cylinders, pistons and related components on a single actuator pump.

This invention accomplishes these and other objectives with an actuator pump having one or more colinear piston cylinders in a cylinder housing in which change of volume is provided by reciprocative relationship of colinear pistons in the colinear piston cylinders. One or more travel guides in sliding contact with guide cylinders in the cylinder housing are parallel to the travel guides. The colinear pistons and travel guides are attached to pump bases at opposite ends of the travel guides. Inward-pressured rings, outward-pressured rings, fluid conveyances, valves and reciprocative actuation are provided selectively for particular design requirements.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
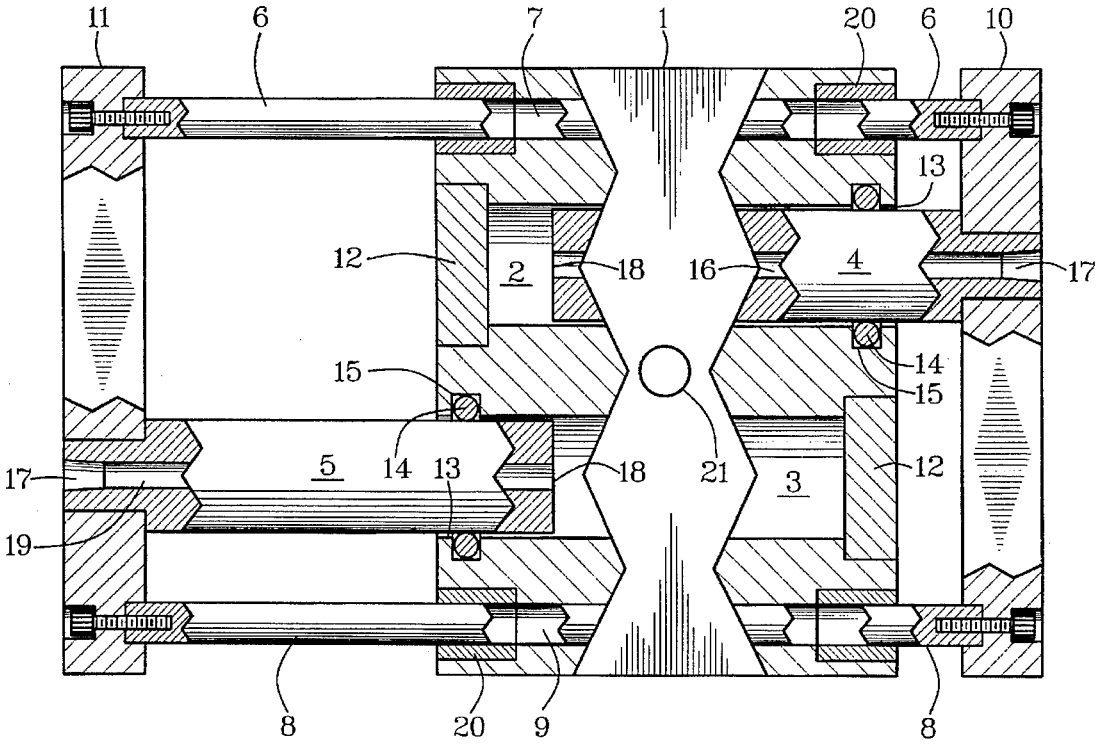
FIG. 1 is a partially cutaway side view of an embodiment having two parallel pistons in piston cylinders between two cylinder guides having guide cylinders in a cylinder housing.

Reference is made first to FIG. 1. A cylinder housing 1 has a first piston cylinder 2 and a second piston cylinder 3. A first piston 4 is in sliding contact with an inside periphery of the first piston cylinder 2 and a second piston 5 is in sliding contact with an inside periphery of the second piston cylinder 3. A first cylinder guide 6 is in linearly sliding contact with an inside periphery of a first guide cylinder 7 and a second cylinder guide 8 is in linearly sliding contact with an inside periphery of a second guide cylinder 9. The first piston cylinder 2, the second piston cylinder 3, the first piston 4, the second piston 5, the first cylinder guide 6, the first guide cylinder 7, the second cylinder guide 8 and the second guide cylinder 9 are colinear. They have parallel axes that can be in different planes or in a common plane. The first piston cylinder 2 has a cylinder axis that is concentric with a piston axis of the first piston 4. The second piston cylinder 3 has a cylinder axis that is concentric with a piston axis of the second piston 5. The first cylinder guide 6 has a cylinder axis that is concentric with a guide-cylinder axis of the first guide cylinder 7. The second cylinder guide 8 has a cylinder axis that is concentric with the second guide cylinder 9.

The first cylinder guide 6 has a first end attached to a first pump base 10 and a second end attached to a second pump base 11. The first piston 4 has a piston base attached to the first pump base 10. The second piston 5 has a piston base attached to the second pump base 11.

The first piston cylinder 2 and the second piston cylinder 3 have cylinder heads 12 and cylinder apertures 13. Sliding seals are provided for this embodiment with resilient O-rings 14 positioned in O-ring grooves 15 in inside peripheries for the first piston cylinder 2 and the second piston cylinder 3 respectively.

A first-cylinder fluid conveyance 16 has fluid communication from a source aperture 17 to space in the first piston cylinder 2 that is proximate a cylinder-inlet aperture 18 in the first-cylinder fluid conveyance 16. A second-cylinder fluid conveyance 19 has fluid communication from a source aperture 17 to space in the second piston cylinder 3 that is proximate a cylinder-Met aperture 18 in the second-cylinder fluid conveyance 19.

Linear bearings 20 can be provided in the first guide cylinder 7 and in the second guide cylinder 8. For use of the linear bearings 20, internal peripheries of the first guide cylinder 7 and the second guide cylinder 8 are designedly smaller than internal peripheries of the linear bearings 20. Linear bearings 20 can be either shaft-guide bearings or piston-guide bearings, depending on where they are used and how they are shaped and sized for use to guide a guide shaft 6 or 8 or to guide a piston 4 or 5.

Embodiments in which the cylinder housing 1 is reciprocated in relation to pump bases 10 and 11 that are stationary can be provided with a reciprocator-attachment component 21 that is represented by a fastener orifice.

There are no inlet and outlet valves in this embodiment because it is an actuator pump for which change of volume in the cylinders 2 and 3 is utilized by conveyance of liquid or gaseous fluid through the fluid conveyances 16 and 19 to actuate mechanisms with fluid instead of with solid members. Valves may or may not be employed in relation to mechanisms which are actuated. In a large selection of mechanisms in which this actuator pump is operable, inlet and outlet valves will not be employed.

Instead of conveying high volume of fluid in a single direction, this embodiment is primarily for conveying fluid accurately and reliably in opposite directions selectively as an actuation means. To provide high accuracy and reliability, a sliding surface on which a sliding seal such as O-ring 14 slides must be maximally smooth and the material must be maximally hard and wear resistant. Machining and/or grinding inside diameters of hard surfaces to high tolerances for relatively long distances is particularly difficult and, therefore, highly expensive if possible to achieve for optimum design requirements. Outside diameters having hard surfaces, however, are relatively easy and, therefore, far less expensive to machine and/or grind to high tolerances. This invention makes it not only possible but also relatively inexpensive to utilize cylinders 2 and 3 having long lengths in proportion to diameters for fluid actuation with high accuracy, high reliability, high range of control and long use life.

Figure 2:
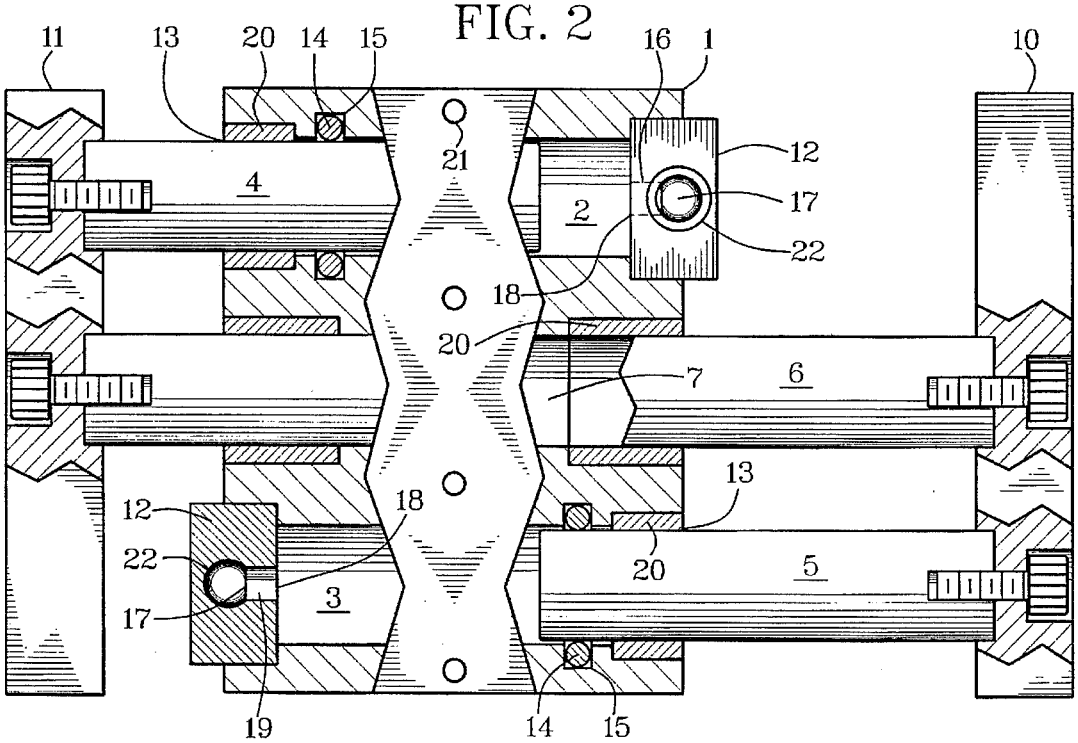
FIG. 2 is a partially cutaway side view of an embodiment having two parallel pistons in piston cylinders that are oppositely disposed from one cylinder guide in a cylinder housing.

Referring to FIG. 2, the first piston cylinder 2 and the second piston cylinder 3 can be positioned designedly in relation to a first guide cylinder 7 with the same working relationships of parts as described in relation to FIG. 1. With the first cylinder guide 6 as an only cylinder guide in this embodiment, linear bearings 20 can be positioned in the first piston cylinder 2 and in the second piston cylinder 3 to compensate for absence of a linear bearing 20 in a second guide cylinder 9 as shown in FIG. 1. The first-cylinder fluid conveyance 16 and the second-cylinder fluid conveyance 19 are in the cylinder heads 12. The source apertures 17 are positioned at a conveyance-attachment aperture 22 in the cylinder heads 12 and the cylinder-inlet apertures 18 are at exits from the cylinder heads 12. Alternatively to positioning the first-cylinder fluid conveyance 16 and the second-cylinder fluid conveyance 19 in the cylinder heads 12 and still have them proximate heads of cylinders 2 and 3, they can be positioned in the cylinder housing 1 proximate cylinder heads 12.

Actuation with a non-compressible fluid such as a liquid medium allows positioning of sliding seals such as O-rings 14 to be positioned relatively near cylinder apertures 13 as depicted without sacrifice of volumetric efficiency.

Figure 3:
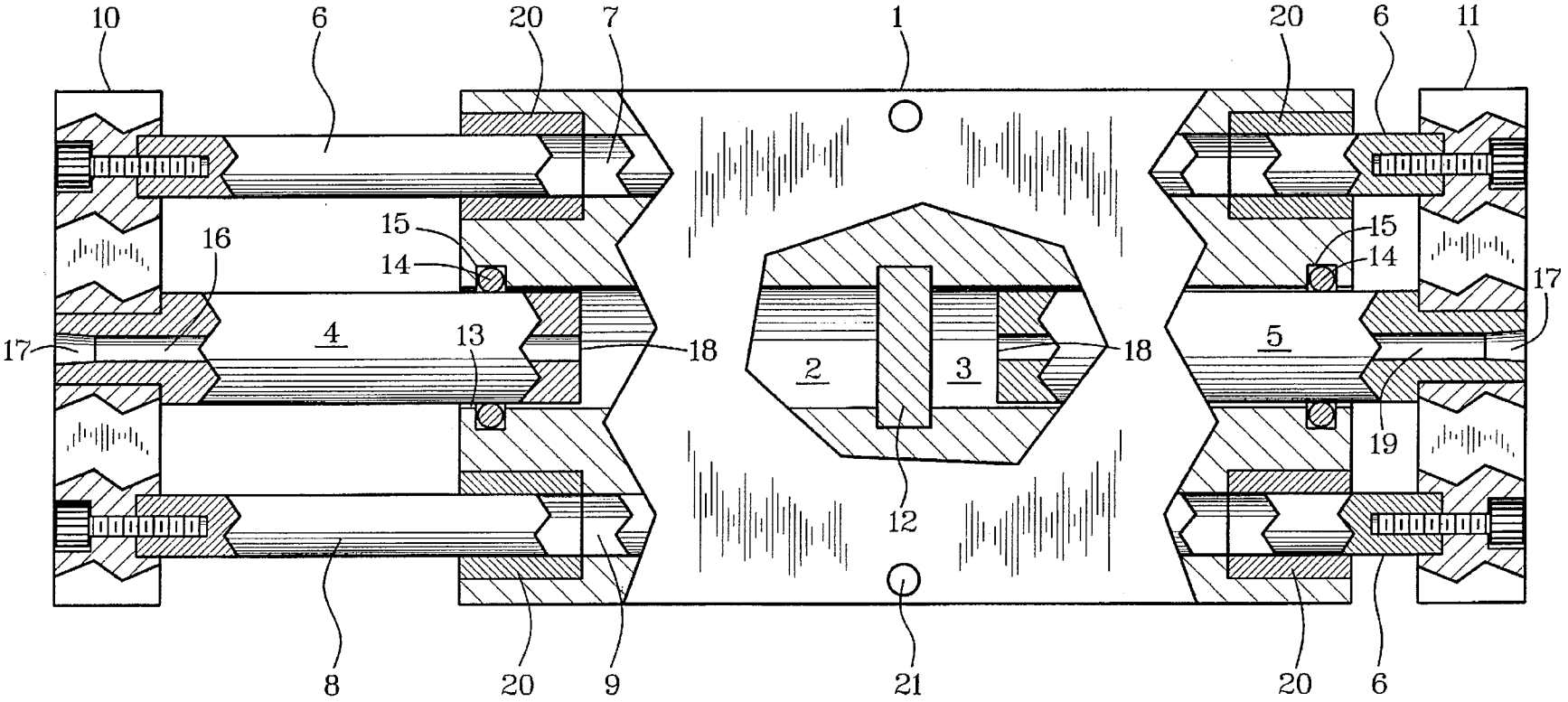
FIG. 3 is a partially cutaway side view of an embodiment having two concentric pistons in piston cylinders between two cylinder guides with guide cylinders in a cylinder housing.

Referring to FIG. 3, the working relationship of parts described for the FIG. 1 embodiment can be similar except for positioning the first piston cylinder 2 and the second piston cylinder 3 in line collinearly instead of side-by-side collinearly. Their axes can be designedly concentric for use of a single cylinder head 12 between them. This is a longer but narrower embodiment.

For most design requirements, the cylinder housing 1 is reciprocated. However, the cylinder housing 1 can be made stationary and the pump bases 10 and 11 reciprocated. Optionally also, both can be reciprocated in opposite directions for particular use conditions.

Figure 4:
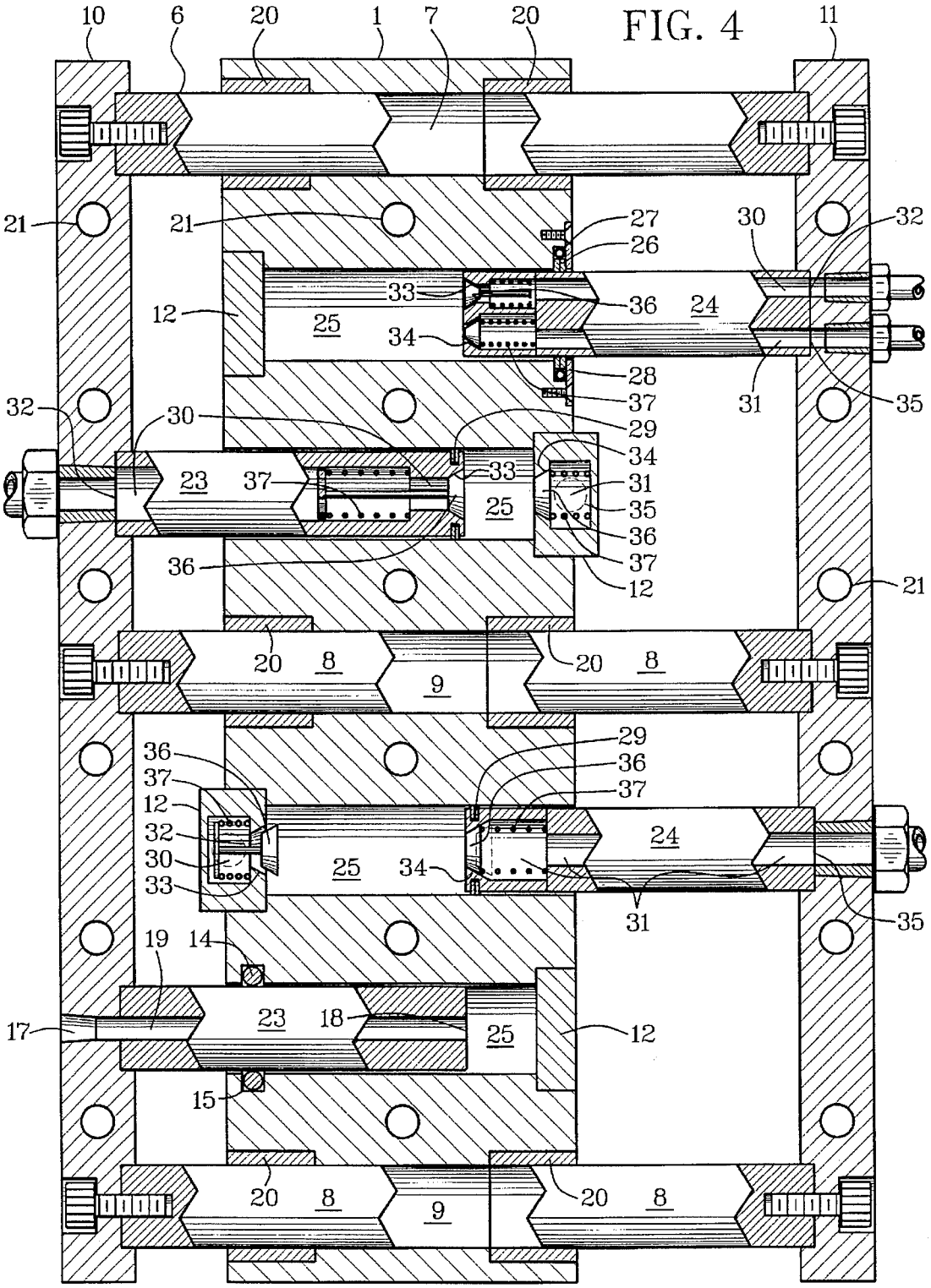
FIG. 4 is a partially cutaway side view of an embodiment having a design plurality of designedly different parallel pistons in piston cylinders and a design plurality of cylinder guides having guide cylinders in a cylinder housing.

Referring to FIG. 4, a design plurality of pistons and a design plurality of cylinders guides can be employed in a single cylinder housing 1 that is positioned in working relationship between a first pump base 10 and a second pump base 11. A main object of this embodiment is to provide different types of pistons for actuation of different types of mechanisms with different types of fluid with a single actuation pump.

The design plurality of cylinder guides can have substantially uniform construction. A first cylinder guide 6 and two second cylinder guides 8 are shown in the same working relationship as described in relation to FIG. 1. First-base pistons 23 are attached to the first pump base 10 and second-base pistons 24 are attached to the second pump base 11. A design plurality of piston cylinders 25 in the cylinder housing 1 are provided for first-base pistons 23 and for second-base pistons 24 in this embodiment. Different types of seals, valves and related fluid conveyances are provided for different types of fluids as actuator mediums. Piston sizes and ratios of diameters to lengths also can be different for particular actuator mediums and for different physical characteristics of particular mechanisms to be actuated.

As depicted in a top portion of FIG. 4, a sliding seal can be an inward-pressured ring 26 that is sleeve-based and has a non-lubricated-solid surface on a cylindrical inside periphery. A seal finish of a circumferential surface of an external periphery of a piston 24 has a non-lubricated-solid surface which is sliding-seal compatible with the non-lubricated-solid surface on the cylindrical inside periphery of the inward-pressured ring 26.

The O-rings 14 described in relation to FIGS. 1–2 are inward-pressured rings but are made of resilient material that is suitable for relatively low-temperature and non-corrosive or low-corrosion conditions.

Achieving inward pressure for an inward-pressured ring 26 without pressure of a pressured medium is difficult with some types of metals, particularly non-lubricated-solid metals and cermets. For this reason it is often practical to pressure them inwardly with a backup ring 27 that is represented by a small coil spring that is positioned for exertion of circumferential resilience. Also, inward-pressured rings 26 tend to deform permanently when overlap squeezed to a sufficiently small diameter for insertion in sleeve-based ring grooves. This is particularly a problem for relatively long cylinders and pistons that provide the range of compression accuracy desired for an actuator. For this reason, a buildup ring groove can be provided with a groove plate 28 that can be bolted on as shown.

For a next lower first-base piston 23, a piston-based seal ring having a ring groove positioned in an external periphery of the piston 23 is an outward-pressured ring 29 can have a non-lubricated-solid surface on a cylindrical outside periphery. For a piston-based seal ring such as the outward-pressured ring 29, a seal finish of a circumferential surface of an internal periphery of the piston cylinder 25 can have a non-lubricated-solid surface which is sliding-seal compatible with a non-lubricated-solid surface on the cylindrical outside periphery of the outward-pressured ring 29.

Actuators generally require bidirectional flow of medium for operation of mechanisms in opposite directions. This can be achieved with the second-cylinder fluid conveyance 19 shown in a first-base piston 23 at a bottom portion of FIG. 4 and described in relation to FIGS. 1–3. Many design requirements will be for pistons with an un-valved fluid conveyance 19 exclusively in an actuator. In such case, all of a design plurality of pistons will be similar to first-base piston 23, although possibly different in piston diameter and related diameter of the fluid conveyance 19. However, some actuator designs will require some or all pistons 23 or 24 to have unidirectional flow of working mediums. Further, some actuators will require pistons 23 or 24 that pump a compressible gas such as air. FIG. 4 illustrates variables of this invention for these and other design requirements.

Outward-pressured rings 29 in a piston 23 for instance, provide greater volumetric efficiency that is desirable for pumping compressible gas for some design requirements. However, production cost, if production is possible, for seal-finishing inside diameters having sufficient lengths per diameters and having non-lubricated solids such as some stainless steels are much higher than for seal-finishing outside diameters.

Unidirectional flow employs a cylinder-inlet conveyance 30 and a cylinder-outlet conveyance 31 as depicted in the top three pistons 23 and 24 instead of the single fluid conveyance 19 that is illustrated in the bottom piston 23 in FIG. 4. The cylinder-inlet conveyance 30 has inlet-valved fluid communication from a source aperture 32 to space in a piston cylinder 25 proximate an inlet aperture 33. The cylinder-outlet conveyance 31 has outlet-valved fluid communication from space in a piston cylinder 25 proximate an outlet aperture 34 to a use aperture 35.

Valves for inlet-valved fluid communication through the cylinder-inlet conveyance 30 and for outlet-valved fluid communication through the cylinder-outlet conveyances 31 are typified by poppet valves 36 with valve springs 37. However, other types of valves such as wafer valves and reed valves can be employed for various design requirements.

Unidirectional flow in the two central pistons 23 and 24 is in opposite directions as a result of valve positioning. This illustrates foreseeable design variation. Piston 23 takes in actuational medium through a source aperture 32 in a pump base 10 and discharges it through a cylinder-outlet conveyance 31 and a use aperture 35 in a cylinder head 12. Piston 24 takes in actuational medium through a source aperture 32 in a cylinder head 12 and discharges it through a use aperture 35 in a pump base 11. The top piston 24 takes in actuational medium through a source aperture 32 in a pump base 11 and discharges it through a use aperture 35 that also is in the pump base 11. These variations will be obvious to those skilled in the pertinent art.

A new and useful actuator pump having been described, all such modifications, adaptations, substitutions of equivalents, combinations of parts, pluralities of parts, applications and forms thereof as described by the following claims are included in this invention.

Having thus described my invention, I claim:

1. An actuator pump comprising:

a first cylinder guide having a first end of the first cylinder guide attached to a first pump base and a second end of the first cylinder guide attached to a second pump base;

the first cylinder guide having an outside periphery and a cylinder-guide axis;

a cylinder housing having a first guide cylinder;

the first guide cylinder having an inside periphery and having a guide-cylinder axis that is concentric with the cylinder-guide axis of the first cylinder guide;

the inside periphery of the first guide cylinder is in linearly sliding contact with the outside periphery of the first cylinder guide;

a first piston attached to the first pump base and having an external periphery, a piston axis, a piston head and a piston base;

a first piston cylinder in the cylinder housing;

the first piston cylinder having an internal periphery, a cylinder axis, a cylinder head and a cylinder aperture;

the piston axis and the cylinder axis being positioned concentrically with the external periphery of the first piston being internal to the internal periphery of the first piston cylinder circumferentially;

a sliding seal having linearly sliding-seal relationship between the internal periphery of the first piston cylinder and the external periphery of the first piston;

a first-cylinder fluid conveyance having fluid communication from a source aperture in the first-cylinder fluid conveyance to space in the first piston cylinder proximate a cylinder-inlet aperture in the first-cylinder fluid conveyance;

a second piston attached to the second pump base and having an external periphery, a piston axis, a piston head and a piston base;

a second piston cylinder in the cylinder housing;

the second piston cylinder having an internal periphery, a cylinder axis, a cylinder head and a cylinder aperture;

the piston axis and the cylinder axis being positioned concentrically with the external periphery of the second piston being internal to the internal periphery of the first piston cylinder circumferentially;

a sliding seal having linearly sliding-seal relationship between the internal periphery of the second piston cylinder and the external periphery of the second piston; and a second-cylinder fluid conveyance having fluid communication from a source aperture in the second-cylinder fluid conveyance to space in the second piston cylinder proximate a cylinder-inlet aperture in the second-cylinder fluid conveyance.

2. An actuator pump as described in claim 1 and further comprising:

a second cylinder guide having a first end of the second cylinder guide attached to the first pump base and a second end of the second cylinder guide attached to the second pump base;

the second cylinder guide having an outside periphery and a cylinder-guide axis;

the cylinder housing having a second guide cylinder;

the second guide cylinder having an inside periphery and having a guide-cylinder axis that is concentric with the cylinder-guide axis of the second cylinder guide; and the inside periphery of the second guide cylinder is in linearly sliding contact with the outside periphery of the second cylinder guide.

3. An actuator pump as described in claim 1 wherein:

the sliding seal having linearly sliding-seal relationship between the internal periphery of a first piston cylinder and an external periphery of a first piston is a sleeve-based seal ring positioned in a ring groove in an internal periphery of the piston cylinder;

the external periphery of the first piston has a circumferential surface with a seal finish;

the sliding deal having linearly sliding-seal relationship between the internal periphery of a second piston cylinder and the external periphery of a second piston is a sleeve-based seal ring positioned in a ring groove in an internal periphery of the second piston cylinder; and the external periphery of the second piston has a circumferential surface with a seal finish.

4. An actuator pump as described in claim 3 wherein:

the sleeve-based seal ring positioned in a ring groove in an internal periphery of a first piston cylinder and the sleeve-based seal ring having a ring groove in an internal periphery of a second piston cylinder respectively are resilient O-rings.

5. An actuator pump as described in claim 1 wherein:

a sleeve-based seal ring positioned in a ring groove in an internal periphery of a piston cylinder is an inward-pressured ring having a non-lubricated-solid surface on a cylindrical inside periphery; and a seal finish of a circumferential surface of an external periphery of a piston has a non-lubricated-solid surface which is sliding-seal compatible with the non-lubricated-solid surface on the cylindrical inside periphery of the inward-pressured ring.

6. An actuator pump as described in claim 1 wherein:

a sliding seal having linearly sliding-seal relationship between an internal periphery of a piston cylinder and an external periphery of a piston is a piston-based seal ring positioned in a ring groove in an external periphery of the piston; and the internal periphery of the piston cylinder has a circumferential surface with a seal finish.

7. An actuator pump as described in claim 6 wherein:

the piston-based seal ring having a ring groove positioned in an external periphery of a piston is an outward-pressured ring that has a non-lubricated-solid surface on a cylindrical outside periphery of the outward-pressured ring; and a seal finish of a circumferential surface of the internal periphery of the piston cylinder has a non-lubricated-solid surface which is sliding-seal compatible with the non-lubricated-solid surface on the cylindrical outside periphery the outward-pressured ring.

8. An actuator pump as described in claim 1 wherein:

the first-cylinder fluid conveyance is in the first piston;

the first-cylinder fluid conveyance has a source aperture in the first pump base and a cylinder-inlet aperture proximate a piston head of the first piston;

the second-cylinder fluid conveyance is in the second piston; and the second-cylinder fluid conveyance has a source aperture in the second pump base and a cylinder-inlet aperture proximate a piston head of the second piston.

9. An actuator pump as described in claim 1 wherein:

a cylinder fluid conveyance is in the cylinder housing; and the cylinder fluid conveyance has a source aperture proximate an external periphery of the cylinder housing and a cylinder-inlet aperture in an internal periphery of the cylinder housing at a position proximate a cylinder head of the piston cylinder.

10. An actuator pump as described in claim 1 and further comprising:

a piston-guide bearing in travel-guide relationship between a piston and a piston cylinder; and a shaft-guide bearing in travel-guide relationship between the first cylinder guide and the first guide cylinder.

11. An actuator pump as described in claim 2 and further comprising:

a shaft-guide bearing in travel-guide relationship between the first cylinder guide and the first guide cylinder; and a shaft-guide bearing in travel-guide relationship between the second cylinder guide and the second guide cylinder.

12. An actuator pump comprising:

an actuator cylinder housing with a first piston cylinder having an internal periphery, a cylinder axis, a cylinder head and a cylinder aperture;

a first piston having an external periphery, a piston axis, a piston head and a piston base;

the cylinder axis and the piston axis being positioned concentrically with the internal periphery of the first piston cylinder being external to the external periphery of the first piston circumferentially;

a sliding seal having linearly sliding-seal relationship between the internal periphery of the first piston cylinder and the external periphery of the first piston, wherein the sliding seal is a sleeve-based seal ring positioned in a ring groove in an internal periphery of the first piston cylinder;

a first pump base to which the first piston base is attached;

a cylinder-inlet conveyance having inlet-valved fluid communication from a source aperture in the cylinder-inlet conveyance to space in the first piston cylinder proximate an inlet aperture in the cylinder-inlet conveyance;

a cylinder-outlet conveyance having outlet-valved fluid communication from space in the first piston cylinder proximate an outlet aperture in the cylinder-outlet conveyance to a use aperture in the cylinder-outlet conveyance; and a first cylinder guide attached to the first pump base and having linearly sliding contact with a first guide surface on the cylinder housing.

13. An actuator pump as described in claim 12 wherein:

the first cylinder guide is a guide rod having a first end of the guide rod attached to the first pump base;

the first guide surface is a guide cylinder in the cylinder housing; and an inside periphery of the guide cylinder has linearly sliding contact with an outside periphery of the guide rod.

14. An actuator pump as described in claim 13 and further comprising:

a second pump base to which a second end of the first cylinder guide is attached.

15. An actuator pump as described in claim 14 and further comprising:

a plurality of guide rods having first ends of the plurality of guide rods attached to the first pump base and having second ends of the plurality of guide rods attached to the second pump base;

the plurality of guide rods having parallel axes;

a plurality of guide cylinders having parallel axes in the cylinder housing; and the plurality of guide rods having external peripheries in linearly sliding contact with internal peripheries of bearing surfaces in the plurality of guide cylinders.

16. An actuator pump as described in claim 15 and further comprising:

a second piston cylinder in the cylinder housing;

the second piston cylinder having an internal periphery, a cylinder axis, a cylinder head and a cylinder aperture;

a second piston having an external periphery, a piston axis, a piston head and a piston base;

the cylinder axis and the piston axis being positioned concentrically with the internal periphery of the second piston cylinder being external to the external periphery of the second piston circumferentially;

a sliding seal having linearly sliding-seal relationship between the internal periphery of the second piston cylinder and the external periphery of the second piston, wherein the sliding seal is a sleeve-based seal ring positioned in a ring groove in an internal periphery of the second piston cylinder;

the second piston being attached to the second pump base;

a cylinder-inlet conveyance having inlet-valved fluid communication from a source aperture in the cylinder-inlet conveyance to space in the second piston cylinder proximate a cylinder-inlet aperture in the cylinder-inlet conveyance; and a cylinder-outlet conveyance having outlet-valved fluid communication from space in the second piston cylinder proximate a cylinder-outlet aperture in the cylinder-outlet conveyance to a use aperture in the cylinder-outlet conveyance.

17. An actuator pump as described in claim 15 and further comprising:

a plurality of piston cylinders in the cylinder housing;

the plurality of piston cylinders having internal peripheries, cylinder axes, cylinder heads and cylinder apertures of the plurality of piston cylinders respectively;

a plurality of pistons attached to the first pump base;

a plurality of pistons attached to the second pump base;

the plurality of pistons having external peripheries, piston axes, piston heads and piston bases of the plurality of pistons respectively;

the cylinder axes and the piston axes being positioned concentrically with the internal peripheries of the plurality of piston cylinders being circumferentially external to the external peripheries of the plurality of pistons respectively;

sliding seals having linearly sliding-seal relationship between internal peripheries of the plurality of piston cylinders and external peripheries of the plurality of pistons, wherein the sliding seals are sleeve-based seal rings positioned in ring groves in internal peripheries of the plurality of piston cylinders;

cylinder-inlet conveyances having inlet-valved fluid communication from source apertures in the cylinder-inlet conveyances to spaces in the plurality of piston cylinders proximate cylinder-inlet apertures in the cylinder-inlet conveyances; and cylinder-outlet conveyances having outlet-valved fluid communication from spaces in the plurality of piston cylinders proximate cylinder-outlet apertures in the cylinder-outlet conveyance to use apertures in the cylinder-outlet conveyances.

18. An actuator pump comprising:

a plurality of cylinder guides having first ends of the plurality of cylinder guides attached to a first pump base and second ends of the plurality of cylinder guides attached to a second pump base;

the plurality of cylinder guides having outside peripheries and cylinder-guide axes that are colinear;

an actuator cylinder housing having a plurality of guide cylinders;

the plurality of guide cylinders having guide-cylinder axes that are concentric with cylinder-guide axes of the plurality of plurality of cylinder guides;

inside peripheries of the plurality of guide cylinders have bearing surfaces that are in linearly sliding contact with outside peripheries of the plurality of cylinder guides;

a plurality of first-base pistons attached to the first pump base and having external peripheries, piston axes, piston heads and piston bases;

a plurality of first-base piston cylinders in the cylinder housing;

the first-base piston cylinders having internal peripheries, cylinders axes, cylinder heads and cylinder apertures;

the piston axes and the cylinder axes being positioned concentrically with external peripheries of the first-base pistons being internal to internal peripheries of first-base piston cylinders circumferentially;

a plurality of sliding seals having linearly sliding-seal relationships between internal peripheries of the plurality of first-base piston cylinders and external peripheries of the plurality of first-base pistons, wherein the sliding seals are sleeve-based seal rings positioned in ring groves in internal peripheries of the plurality of first-base pistons;

a plurality of second-base pistons attached to the second pump base and having external peripheries, piston axes, piston heads and piston bases;

a plurality of second-base piston cylinders in the cylinder housing;

the second-base piston cylinders having internal peripheries, cylinders axes, cylinder heads and cylinder apertures;

the piston axes and the cylinder axes being positioned concentrically with external peripheries of the second-base pistons being internal to internal peripheries of second-base piston cylinders circumferentially; and a plurality of sliding seals having linearly sliding-seal relationships between internal peripheries of the plurality of second-base piston cylinders and external peripheries of the plurality of second-base pistons, wherein the sliding seals are sleeve-based seal rings positioned in ring groves in internal peripheries of the plurality of second-base pistons.

19. An actuator pump as described in claim 18 wherein:

select first-base pistons of the plurality of first-base pistons and select second-base pistons of the plurality of second-base pistons are sized, shaped and structured for select requirements; and the plurality of first-base piston cylinders and the plurality of second-base piston cylinders are sized, shaped and structured to match select first-base pistons and select second-base pistons that are sized, shaped and structured for select requirements.

* * * * *